US005655502A

United States Patent [19]

Enomoto et al.

[11] Patent Number: 5,655,502

[45] Date of Patent: Aug. 12, 1997

[54] INJECTION TIMING CONTROL DEVICE FOR FUEL INJECTION PUMP

[75] Inventors: Shigeiku Enomoto; Yasuyuki Sakakibara; Moriyasu Gotoh, all of Nishio, Japan

[73] Assignee: Nippon Soken, Inc., Nishio, Japan

[21] Appl. No.: 592,860

[22] Filed: Jan. 24, 1996

[30] Foreign Application Priority Data

Jan. 24, 1995 [JP] Japan ..... 7-009034
Nov. 8, 1995 [JP] Japan ..... 7-290114

[51] Int. Cl.[6] ..... F02M 37/04

[52] U.S. Cl. ..... 123/502

[58] Field of Search ..... 123/500–503

[56] References Cited

U.S. PATENT DOCUMENTS 4,658,793 4/1987 Bonin ..... 123/502
5,370,096 12/1994 Cooke ..... 123/502

FOREIGN PATENT DOCUMENTS 56-173736 12/1981 Japan .
60-132038 7/1985 Japan .
62-101865 5/1987 Japan .
63-110640 7/1988 Japan .
2-211374 8/1990 Japan .

*Primary Examiner*—Thomas N. Moulis
*Attorney, Agent, or Firm*—Cushman, Darby & Cushman, IP Group of Pillsbury, Madison & Sutro, LLP

[57] ABSTRACT

An injection timing control device for a fuel injection pump includes an oil-pressure control valve for controllably changing the fuel injection timing of the fuel injection pump. The oil-pressure control valve includes a valve cylinder having a valve seat. The valve seat has a first truncated-conical surface. The oil-pressure control valve further includes a valve needle slidably received in the valve cylinder and movable by a control unit. The valve needle has a second truncated-conical surface for engaging with the first truncated-conical surface to close the oil-pressure control valve and disengaging from the first truncated-conical surface to open the oil-pressure control valve. The first and second truncated-conical surfaces, when engaged, form a circular seal line on which the first and second truncated-conical surfaces abut each other. The circular seal line has a diameter which is substantially the same as a diameter of the valve needle. In the oil-pressure control valve, a fuel pressure applied to the valve needle at one axial end thereof is introduced to an opposite axial end thereof for equalizing fuel pressures applied to the valve needle at the opposite ends thereof.

11 Claims, 15 Drawing Sheets

INJECTION TIMING CONTROL DEVICE FOR FUEL INJECTION PUMP

BACKGROUND OF THE INVENTION

1. Field of the Invention

The present invention relates to a fuel injection pump for use mainly in a diesel engine, and more specifically, to an injection timing control device for a distributor type fuel injection pump, including a fuel-pressure control valve which is operated under the command of an electronic control unit (ECU) for controlling the fuel injection timing of the fuel injection pump.

2. Description of the Prior Art

As disclosed such as in Japanese First (unexamined) Utility Model Publication No. 63-110640, in the distributor type fuel injection pump for the diesel engine, a timer piston is provided for changing the displacing timing of a cam. The displacing timing of the cam controls the displacing timing of a plunger which is provided for feeding fuel under high pressure. A fuel-pressure control valve is provided between pressure chambers located at opposite sides of the timer piston for adjusting a pressure differential applied across the timer piston so as to control a position of the timer piston. The position of the timer piston defines the displacing timing of the cam so that the fuel injection timing is controlled via the movement of the plunger.

In, for example, Japanese First (unexamined) Utility Model Publication No. 56-173736, a fuel-pressure control valve is in the form of a solenoid valve. Accordingly, by controlling energization and deenergization of a coil of the solenoid valve for changing a pressure differential across a timer piston so as to adjust a position of the timer piston, the fuel injection timing of the fuel injection pump can be controlled electronically.

FIG. 14 shows an example of the conventional fuel-pressure control valve as generally designated at numeral 80. Communication between passages 41 and 42 is determined by controlling energization of a coil 54. Specifically, when the coil 54 is energized, an armature 52 integrated with a valve needle 98 is attracted toward a stator 53 against a biasing force of a spring 57 to move rightward in the figure until an intermediate surface 99 of the valve needle 98 abuts a shim 100. Thus, the fuel-pressure control valve 80 is opened to establish communication between the passages 41 and 42. A valve lift $l_7$ at this time is $l_7$=0.7 mm. An air gap $l_8$ as an interval between the armature 52 and the stator 53 has a relationship with the valve lift $l_7$ so that $l_8=l_8+0.05$ mm. Accordingly, $l_8$=0.75 mm when the valve 80 is closed, while $l_8$=0.05 mm when the valve 80 is opened. When the coil 54 is deenergized, the armature 52 integrated with the valve needle 98 moves leftward in the figure due to the biasing force of the spring 57 so that the valve 80 is closed.

In recent years, following the strengthening of exhaust gas regulation, the synchronous control relative to engine rotation has been required also for the oil-pressure control valve in the injection timing control device for the fuel injection pump as described in Japanese First (unexamined) Patent Publication No. 62-101865. This inevitably requires the high-speed response of the valve needle 98. However, the conventional fuel-pressure control valve 80 as shown in FIG. 14 requires a long time from energization of the coil 54 to the valve opening, that is, the valve opening response is significantly poor. Thus, the fuel-pressure control valve with an improved valve opening response has been demanded.

For improving the valve opening response of the valve 80, that is, the valve needle 98, it is essential to shorten a time period from energization of the coil 54 to generation of the sufficient attraction force. For achieving this, it is effective to reduce the number of coil turns N as shown in FIG. 15. However, when the number of coil turns N is reduced, the larger quantity of current is required for achieving the same attraction force so that a drive circuit for the valve 80 is increased in cost.

On the other hand, as shown in FIG. 16, when the air gap $l_8$ is reduced, the larger attraction force can be achieved with the smaller current. In this case, however, since the valve lift $l_7$ should be inevitably reduced, a sufficient magnitude of passage area can not be achieved between the passages 41 and 42 via a groove 98*a* of the valve needle 98.

In the meantime, due to the recent cost-reduction requirement, it has been proposed to decrease the cost of the fuel-pressure control valve, using a portion of parts of a fuel injection valve (solenoid valve) for the gasoline engine since the gasoline engines have been produced in large quantities. Examples are shown in Japanese First (unexamined) Patent Publications Nos. 60-132038 and 2-211374. FIG. 17 shows the fuel-pressure control valve described in the former publication, as generally designated at numeral 101.

In FIG. 17, during a high-pressure fuel feeding stroke of a plunger (not shown), a timer piston 21 is urged upward in the figure due to a reaction force from a face cam (not shown) applied via a slide pin 19. Thus, a timer high-pressure chamber 22 increases in pressure in proportion to fuel injection pressure during the high-pressure fuel feeding by the plunger. The timer high-pressure chamber 22 communicates with a housing chamber 102 via a passage 103 and further communicates with a passage 107 arranged surrounding a valve needle 106 via a passage 105 formed in a valve body 104. Since the passage 107 further communicates with a spring chamber 108, the spring chamber 108 is at a pressure equal to that in the timer high-pressure chamber 22. On the other hand, since a timer low-pressure chamber 24 is at a pressure which is constantly lower than that in the timer high-pressure chamber 22, a chamber 110 communicating with the timer low-pressure chamber 24 via a passage 109 is also under the low pressure. With this arrangement, when the pressure in the timer high-pressure chamber 22 is increased, the pressure in the spring chamber 108 is also increased so that the valve needle 106 is urged leftward in the figure with an increased force, which is opposite to a valve opening direction of the fuel-pressure control valve 101. Accordingly, the valve opening response of the valve 101 changes depending on the pressure in the timer high-pressure chamber 22. Thus, the fuel injection timing can not be controlled accurately.

Further, since the housing chamber 102 also increases in pressure to a high value every time the plunger achieves the high-pressure fuel feeding, the fuel-pressure control valve 101 repeatedly receives loads rightward in the figure so that bolts 111 by means of which the valve 101 is fixed to a housing 17 are subjected to fatigue failure.

SUMMARY OF THE INVENTION

Therefore, it is an object of the present invention to provide an improved injection timing control device for a fuel injection pump.

According to one aspect of the present invention, an injection timing control device for a fuel injection pump comprises a timer cylinder; a timer high-pressure chamber and a timer low-pressure chamber provided at opposite ends of the timer cylinder; a timer piston slidably received in the timer cylinder and movable depending on a pressure differential between the timer high-pressure chamber and the timer low-pressure chamber to adjust an injection timing of fuel; and a fuel-pressure control valve for changing a fuel pressure in at least one of the timer high-pressure chamber and the timer low-pressure chamber. The fuel-pressure control valve comprises a valve body; a valve cylinder formed in the valve body and having a valve seat, the valve seat having a first truncated-conical surface; a valve needle slidably received in the valve cylinder and movable by a control unit, the valve needle having a second truncated-conical surface for engaging with the first truncated-conical surface to close the fuel-pressure control valve and disengaging from the first truncated-conical surface to open the oil-pressure control valve; and means for introducing a fuel pressure applied to the valve needle at one axial end thereof to an opposite axial end thereof for equalizing fuel pressures applied to the valve needle at the opposite ends thereof; wherein the first and second truncated-conical surfaces, when engaged, form a circular seal line on which the first and second truncated-conical surfaces abut each other, the circular seal line having a diameter which is substantially the same as a diameter of the valve needle.

It may be arranged that the pressure introducing means comprises a communication passage formed in the valve needle.

It may be arranged that a filter is provided at an upstream side of the valve seat.

It may be arranged that the filter has a filter aperture which is smaller than a maximum valve lift of the valve needle.

It may be arranged that a valve opening direction of the valve needle is essentially opposite to a flow direction of the fuel passing through the fuel-pressure control valve when opened.

It may be arranged that the valve needle has first and second axial sides, the first axial side located in the valve opening direction with respect to the second axial side, and that the valve needle has the truncated-conical surface at the second side.

It may be arranged that a valve opening direction of the valve needle is essentially the same as a flow direction of the fuel passing through the fuel-pressure control valve when opened.

It may be arranged that the valve needle has first and second axial sides, the first axial side located in the valve opening direction with respect to the second axial side, and that the valve needle has the truncated-conical surface at the first side.

It may be arranged that an inclination of the first truncated-conical surface is smaller than an inclination of the second truncated-conical surface.

It may be arranged that an inclination of the first truncated-conical surface is greater than an inclination of the second truncated-conical surface.

It may be arranged that the valve body is received in a housing and an O-ring is provided between the housing and the valve body.

BRIEF DESCRIPTION OF THE DRAWINGS

The present invention will be understood more fully from the detailed description given hereinbelow, taken in conjunction with the accompanying drawings.

In the drawings.

DESCRIPTION OF THE PREFERRED EMBODIMENT

Now, preferred embodiments of the present invention will be described hereinbelow with reference to the accompanying drawings. Throughout the figures including the figures showing the prior art, the same signs or symbols represent the same or like components.

Prior to description of an injection turning control device, particularly, a fuel-pressure control valve used therein, for a fuel injection pump according to each of the preferred embodiments, explanation will be first made to two timer modes for the fuel injection pumps, that is, a timer high-pressure chamber control mode and a timer low-pressure chamber control mode.

Figure 1:
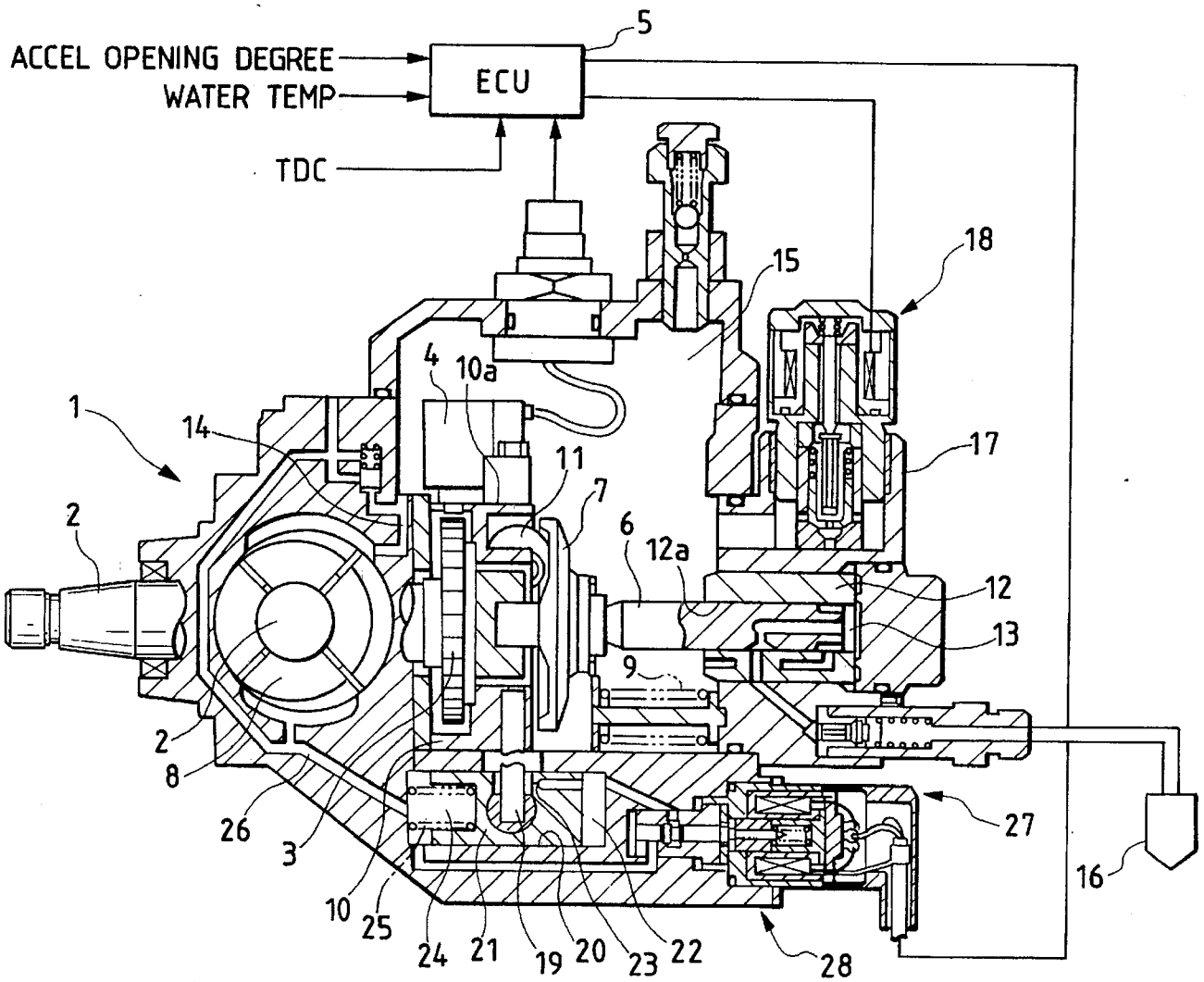
FIG. 1 is a sectional view showing a systematic structure of a distributor type fuel injection pump with an injection timing control device of a timer high-pressure chamber control mode.

FIG. 1 shows a structure of a distributor type fuel injection pump 1 with a timer or an injection timing control device 28 of the timer high-pressure chamber control mode.

A drive shaft 2 is driven by an engine (not shown) to rotate at a speed which is half a speed of the engine. A signal rotor 3 is coaxially mounted on the drive shaft 2 and formed with a plurality of teeth on the circumference thereof. Numeral 4 denotes a speed sensor confronting the toothed circumference of the signal rotor 3. The speed sensor 4 produces a pulse signal depending on the rotational speed of the drive shaft 2 and thus the engine speed by means of the electromagnetic induction caused by the teeth of the signal rotor 3 and outputs it to an electronic control unit (ECU) 5. The ECU 5 includes drive circuits for driving a spill valve 18 and an oil-pressure control valve 27. To the drive shaft 2 are coupled a face cam 7 which drives a plunger 6 for feeding the fuel under high pressure, and a vane-type fuel feed pump 8 which feeds the fuel to the fuel injection pump 1 from a fuel tank (not shown). The face cam 7 is integrated with the plunger 6 and pressed against a roller 11 arranged on a roller ring 10 by means of a spring 9.

Accordingly, when the face cam 7 is rotated by the drive shaft 2, a convex portion of the face cam 7 rides on and off the roller 11 so that the face cam 7 together with the integrated plunger 6 makes the rotational reciprocating motion along an axis of the plunger 6. The plunger 6 is received in a cylinder bore 12*a* of a pump cylinder 12 and defines a pressure chamber 13 at its tip. The volume of the pressure chamber 13 is increased and decreased due to the reciprocating motion of the plunger 6 while an inlet port and an outlet port selectively communicate with the pressure chamber 13 due to the rotational motion of the plunger 6. The fuel pressurized approximately at 10 atm. and discharged from an outlet port 14 of the fuel feed pump 8 is stored in a fuel chamber 15. The fuel stored in the fuel chamber 15 is sucked into the pressure chamber 13 and pressurized to a high pressure so as to be fed at a given timing to a fuel injection valve 16 where the pressurized fuel is injected into a combustion chamber (not shown) of the engine. The spill valve 18 is provided in a housing 17 of the fuel injection pump 1 for releasing the pressure in the pressure chamber 13. By controlling opening and closing operations of the spill valve 18 by means of the ECU 5, a fuel injection start timing, a fuel injection quantity and a fuel injection rate can be controlled.

The roller ring 10 is allowed to turn within a given angular range with respect to an axis of the drive shaft 2. With this angular displacement of the roller ring 10, a cylindrical outer periphery 10*a* and the roller 11 move in a turning direction of the roller ring 10. Thus, a timing when the convex portion of the face cam 7 rides on the roller 11 is changed so that the fuel injection timing of the fuel injection pump 1 can be changed. For turning the roller ring 10, a slide pin 19 extends downward in FIG. 1 from the roller ring 10 so as to engage with a timer piston 21 at its lower end. The timer piston 21 is received in a timer cylinder 20 formed in the housing 17 so as to be slidable rightward and leftward in FIG. 1 in a reciprocating manner.

In FIG. 1, a timer high-pressure chamber 22 located at the right of the timer piston 21 communicates with the fuel chamber 15 via a throttling 23 formed in the timer piston 21 and thus receives the fuel pressurized by the fuel feed pump 8. The pressure applied to the timer high-pressure chamber 22 urges the timer piston 21 leftward in the figure. On the other hand, a timer spring 25 is disposed in a timer low-pressure chamber 24 located at the left of the timer piston 21 for urging the timer piston rightward in the figure. The timer low-pressure chamber 24 communicates with an inlet port 26 of the fuel feed pump 8 and thus is constantly under low pressure in operation. The fuel or oil pressure applied to the timer high-pressure chamber 22 changes depending on the engine speed and thus the rotational speed of the drive shaft 2. The timer piston 21 moves to a position where a biasing force caused by the fuel pressure in the timer high-pressure chamber 22 and a biasing force of the timer spring 25 in the timer low-pressure chamber 24 are balanced. Thus, the roller ring 10 is turned accordingly via the slide pin 19 to determine an angular position of the roller 11 so that the fuel injection timing changes depending on the engine speed. Further, during a high-pressure fuel feeding stroke of the plunger 6, the timer piston 21 is urged rightward in the figure via the slide pin 19 due to a reaction force applied to the face cam 7 via the plunger 6 so that the timer high-pressure chamber 22 is temporarily increased in pressure to a high value.

The fuel-pressure control valve 27 in the form of a solenoid valve is interposed between the timer high-pressure chamber 22 and the timer low-pressure chamber 24. The fuel-pressure control valve 27 is electrically connected to the ECU 5. The ECU 5 controls opening and closing operations of the valve 27 to adjust the pressure in the timer high-pressure chamber 22 by partially releasing the pressure in the timer high-pressure chamber 22 to the timer low-pressure chamber 24, thereby changing a position of the timer piston 21 and thus an angular position of the roller ring 10 so as to control the fuel injection timing.

In FIG. 1, the timer cylinder 20, the timer piston 21, the roller ring 10, the fuel-pressure control valve 27 and the like constitute the injection timing control device 28 for the distributor type fuel injection pump 1. For facilitating understanding, the drive shaft 2 and the timer piston 21 are illustrated in parallel with each other in FIG. 1. However, for achieving the foregoing operations, the latter is actually arranged orthogonal to the former. Similarly, although a shaft of the fuel feed pump 8 is illustrated as being orthogonal to the drive shaft 2 in FIG. 1, the shaft of the fuel feed pump 8 is actually an extension of the drive shaft 2 on the same axis.

The foregoing speed sensor 4 is fixed on the outer periphery 10*a* of the roller ring 10. An output signal of the speed sensor 4 is inputted to the ECU 5. As shown in FIG. 1, the ECU 5 is further inputted with, for example, a signal indicative of top dead center (TDC) of the engine, a signal indicative of accel opening degree representing an engine load, and a signal indicative of engine coolant temperature from a water temperature sensor.

Figure 2:
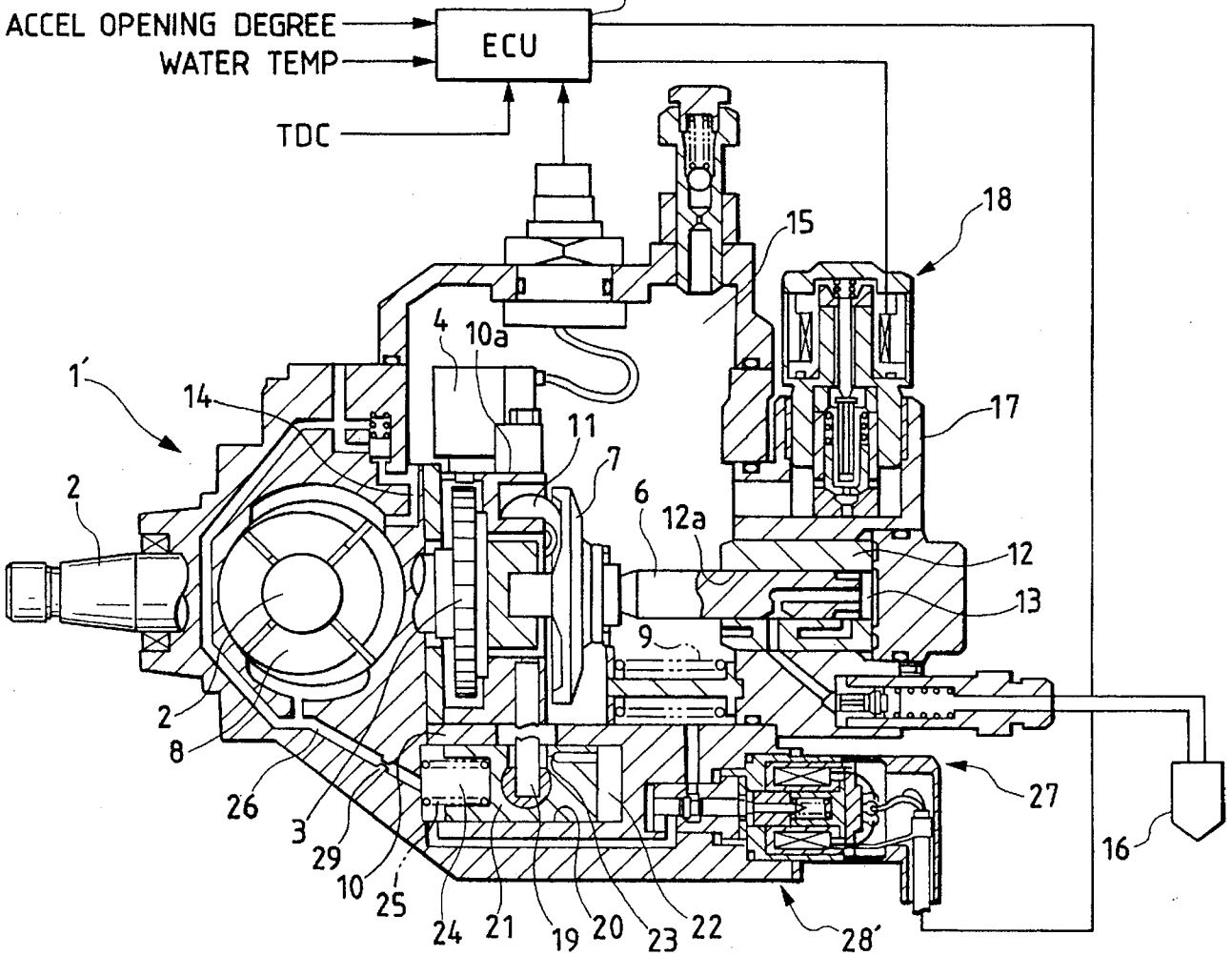
FIG. 2 is a sectional view showing a systematic structure of a distributor type fuel injection pump with an injection timing control device of a timer low-pressure chamber control mode.

FIG. 2 shows a structure of a distributor type fuel injection pump 1' with a timer or an injection timing control device 28' of the timer low-pressure chamber control mode. The structure shown in FIG. 2 is substantially the same as that shown in FIG. 1 in large part. Accordingly, explanation of the same or like components will be omitted by assigning the same signs as those in FIG. 1.

In FIG. 2, a timer high-pressure chamber 22 located at the right of a timer piston 21 communicates with a fuel chamber 15 via a throttling 23 and thus receives the fuel pressurized approximately at 10 atm. by a fuel feed pump 8. A timer spring 25 is disposed in a timer low-pressure chamber 24 located at the left of the timer piston 21. The timer low-pressure chamber 24 communicates with an inlet port 26 of the fuel feed pump 8 via a throttling 29. Accordingly, by adjusting a fuel quantity introduced into the timer low-pressure chamber 24 from the fuel chamber 15 by means of a fuel-pressure control valve 27, a pressure in the timer low-pressure chamber 24 is determined in a range from an atmospheric pressure to approximately 10 atm. equal to the pressure in the fuel chamber 15. A position of the timer piston 21 is determined based on a balanced condition between a force generated by a pressure differential across the timer piston, that is, between the timer high-pressure chamber 22 and the timer low-pressure chamber 24, and a biasing force of the timer spring 25.

Now, a first preferred embodiment of the present invention will be described hereinbelow with reference to FIGS. 3 to 5.

Figure 3:
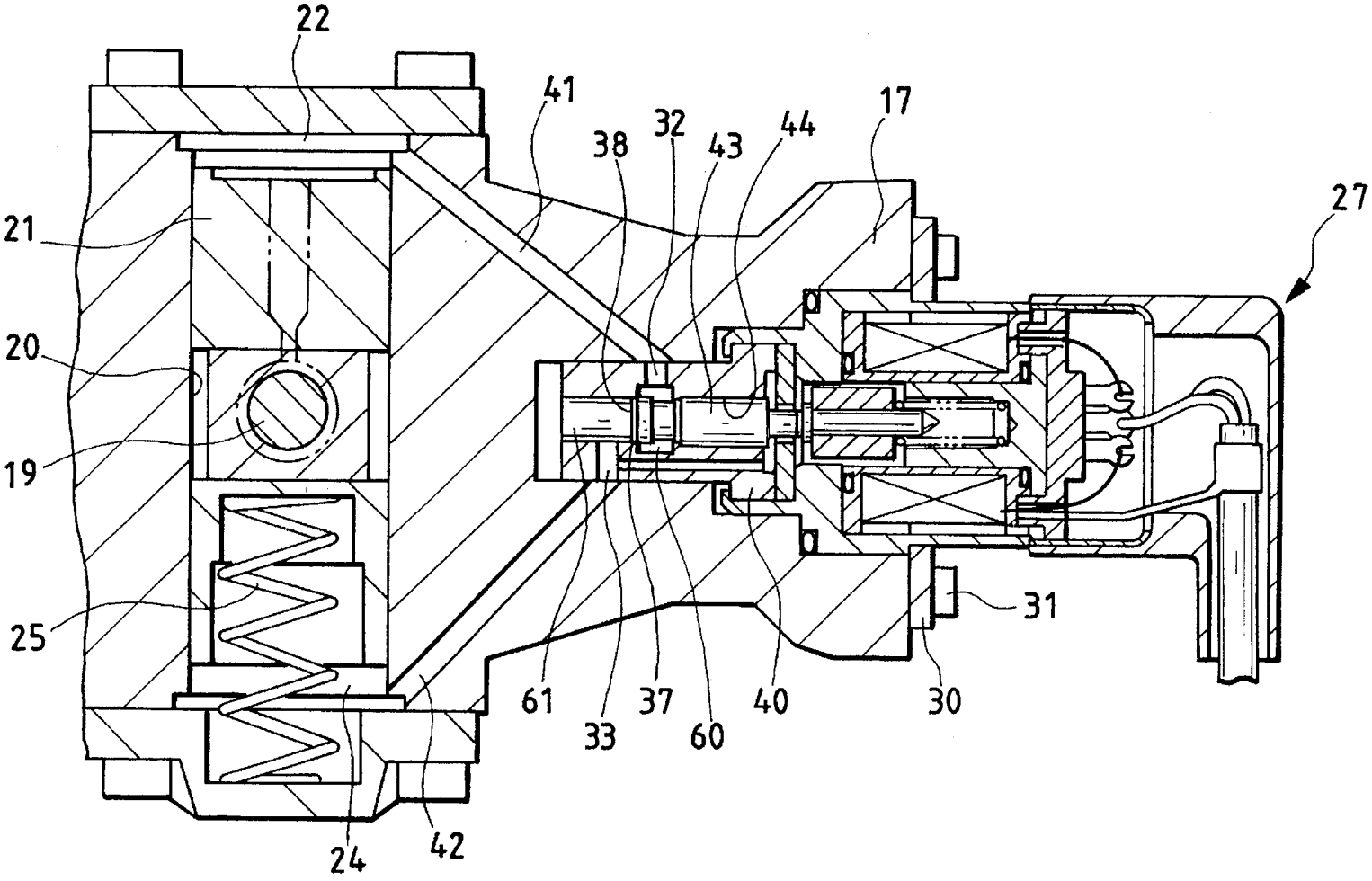
FIG. 3 is a sectional view showing an injection timing control device for a fuel injection pump according to a first preferred embodiment of the present invention, wherein an oil-pressure control valve is illustrated as being associated with a timer cylinder.

FIG. 3 is a sectional view showing an injection timing control device for a fuel injection pump, wherein a fuel-pressure control valve 27 is illustrated as being associated with a timer cylinder 20. As appreciated, in FIG. 3, the fuel-pressure control valve 27 is applied to the injection timing control device of the timer high-pressure chamber control mode as shown in FIG. 1. The fuel-pressure control valve 27 is fixed to a housing 17 using a flange 30 and bolts 31. A valve body 40 is formed through its center with a valve cylinder 44 for slidably receiving a valve needle 43 therein. The valve cylinder 44 includes an annular passage 60 and a passage 61 at a downstream side of the annular passage 60. The annular passage 60 and the passage 61 cooperatively form a valve seat 37 for the valve needle 43. The valve body 40 is fitted in the housing 17. The annular passage 60 communicates with a timer high-pressure chamber 22 via a passage 32 formed in the valve body 44 and a passage 41 formed in the housing 17. On the other hand, the passage 61 communicates with a timer low-pressure chamber 24 via a passage 33 formed in the valve body 44 and a passage 42 formed in the housing 17.

In case of the injection timing control device 28' of the timer low-pressure chamber control mode as shown in FIG. 2, the annular passage 60 communicates with the fuel chamber 15 via the passage 32, instead of the timer high-pressure chamber 22.

Figure 4:
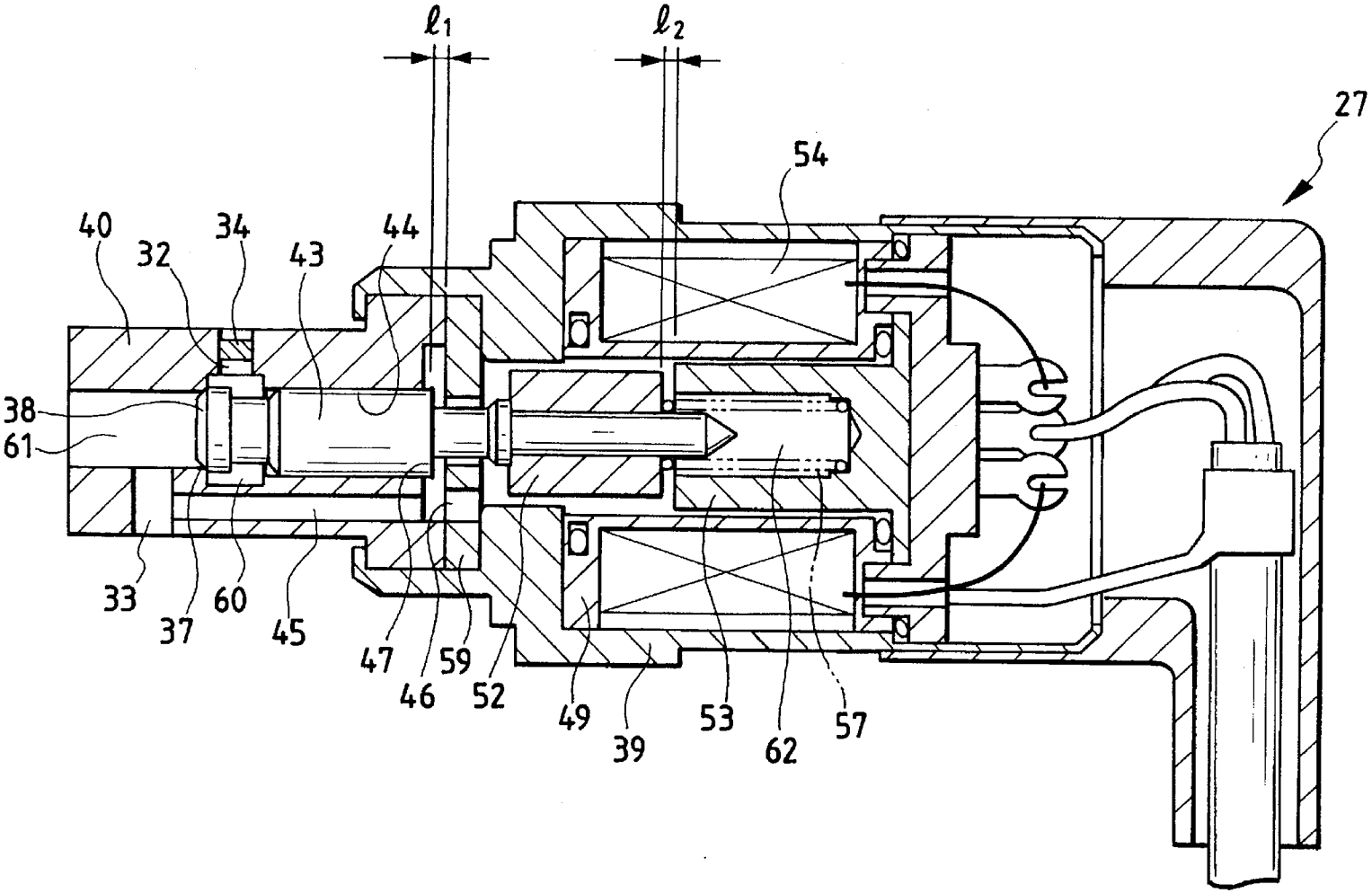
FIG. 4 is a sectional view showing the fuel-pressure control valve shown in FIG. 3 on an enlarged scale.

FIG. 4 shows the fuel-pressure control valve 27 shown in FIG. 3 on an enlarged scale. In the valve cylinder 44, the valve needle 43 is disposed so as to be slidable rightward and leftward in the figure. An armature 52 is fixed on the valve needle 43 on the right side thereof in the figure by press fitting. The armature 52 confronts a stator 53 with an interval (air gap) $l_2$ therebetween. In the stator 53 is formed a spring chamber 62 in which a spring 57 is disposed for urging the armature 52 leftward in the figure.

Accordingly, when a coil 54 is deenergized, the tip of the valve needle 43 abuts the valve seat 37, that is, the valve needle 43 is seated on the valve seat 37, so that the fuel-pressure control valve 27 is closed to prohibit communication between the timer high-pressure chamber 22 and the timer low-pressure chamber 24. On the other hand, when the coil 54 is energized, the armature 52 is attracted by the stator 53 to move rightward in the figure against the biasing force of the spring 57 so that the tip of the valve needle 43 integrated with the armature 52 is separated from the valve seat 37. Thus, the fuel-pressure control valve 27 is opened to establish communication between the timer high-pressure chamber 22 and the timer low-pressure chamber 24. A valve lift $l_1$ of the valve needle 43 at this time is $l_1$=0.12 mm. As appreciated, the lift motion of the valve needle 43 is finished at a position where a right shoulder 47 of the valve needle 43 abuts a shim 59. The air gap $l_2$ is $l_2$=0.17 mm when the valve is closed, while $l_2$=0.05 mm when the valve is opened.

Since it is preferable to most advance the fuel injection timing rather than most retard the fuel injection timing, assuming failure of the coil 54, the fuel-pressure control valve 27 is arranged to be normally closed as described above.

The coil 54 is wound around a coil bobbin 49 and received in a casing 39. A left end, in the figure, of the casing 39 is caulked so as to fix the valve body 40 thereto, and a right end thereof is also caulked to fix the stator 53 and so forth.

Now, a structure around a tip portion of the valve needle 43 or a seat section of the oil-pressure control valve 27 will be described with reference to FIG. 5. As appreciated, FIG. 4 shows the state where the valve is closed, while FIG. 5 shows the state where the valve is opened. In the valve body 40, the annular passage 60 is formed surrounding the valve needle 43 and the passage 61 is formed at the downstream side of the annular passage 60 or the valve needle 43. Communication between the passages 60 and 61 is established or prohibited by means of the cooperation of the valve seat 37 and the valve needle 43. A valve diameter $d_1$ of the valve needle 43 is set to 5.0 mm and an inclination $\theta_1$ of a truncated-conical surface 38 formed at the tip of the valve needle 43 is set to 93°. On the other hand, an inclination $\theta_2$ of a truncated-conical surface of the valve seat 37 is set to 90°, a right-end or largest diameter $d_2$ of the truncated-conical surface of the valve seat 37 is set to 5.1 mm, and a diameter $d_3$ of the passage 61 is set to 4.4 mm. If $d_3$ is too large relative to $d_2$, an area of the valve seat 37 becomes insufficient so that the surface of the valve seat 37 is worn. On the other hand, if $d_3$ is too small relative to $d_2$, the fuel tends to leak even slightly due to roughness in processing of the truncated-conical surface 38 even when the valve needle 43 is seated on the valve seat 37. Since the pressure of the leaking fuel increases a force for pushing the valve needle 43 rightward in the figure, failure in valve closing is resulted.

Figure 14:
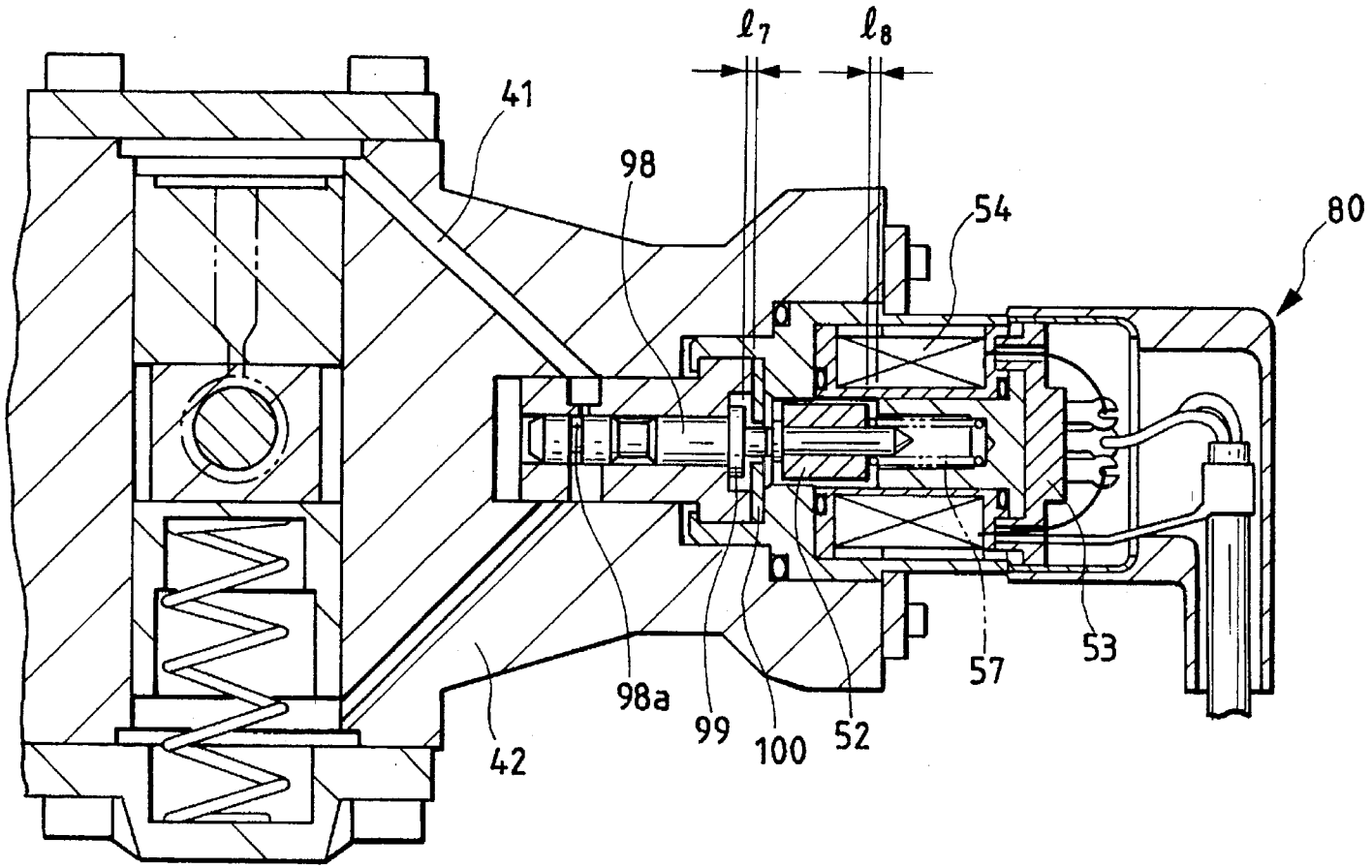
FIG. 14 PRIOR ART
FIG. 14 is a sectional view showing a fuel-pressure control valve in a conventional injection timing control device.
Figure 15:
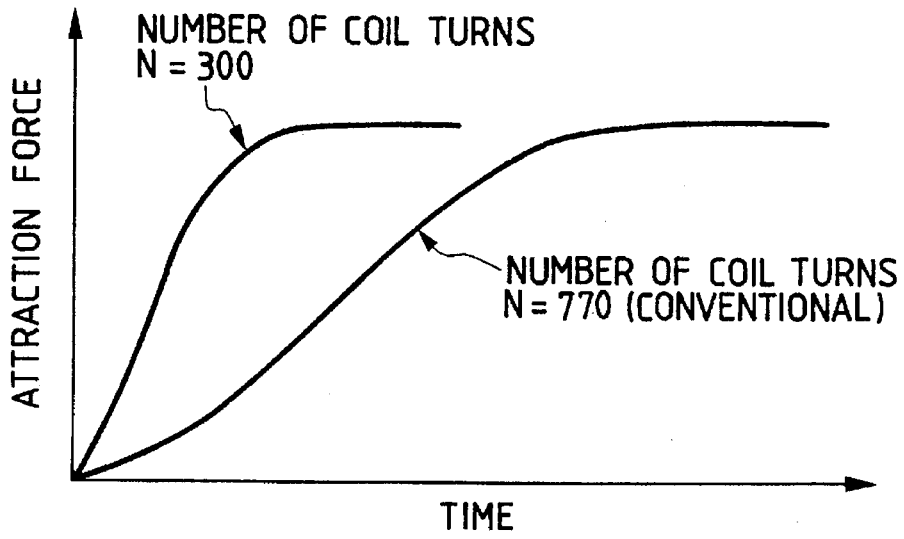
FIG. 15 is a diagram showing a relationship between the number of coil turns and an attraction force in terms of time, that is, a relationship between the number of coil turns and a valve opening response of a fuel-pressure control valve.
Figure 16:
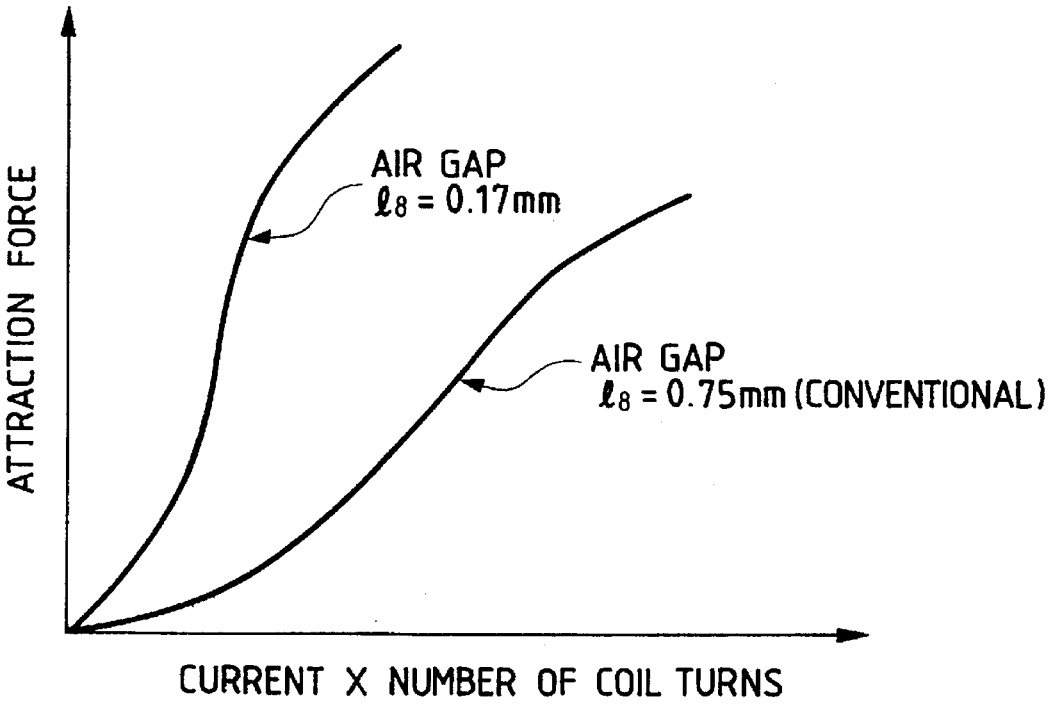
FIG. 16 is a diagram showing a relationship between an air gap and an attraction force in terms of the product of a magnitude of current and the number of coil turns.

With the foregoing arrangement around the tip portion of the valve needle 43, a seal edge 36 of the truncated-conical surface 38 tightly abuts the surface of the valve seat 37 to prohibit communication between the passages 60 and 61 when the valve is closed. As appreciated, the seal edge 36 forms a circular line on which the truncated-conical surface 38 of the valve needle 43 and the truncated-conical surface of the spring seat 37 abut each other when the valve is closed. In FIG. 5, since the seal edge 36 has a diameter which is equal to the diameter $d_1$ of the valve needle 43, a sufficiently large open area can be achieved between the truncated-conical spring seat 37 and the truncated-conical surface 38 of the valve needle 43 with a smaller valve lift of the valve needle 43 as compared with the conventional fuel-pressure control valve 80 shown in FIG. 14.

Figure 5:
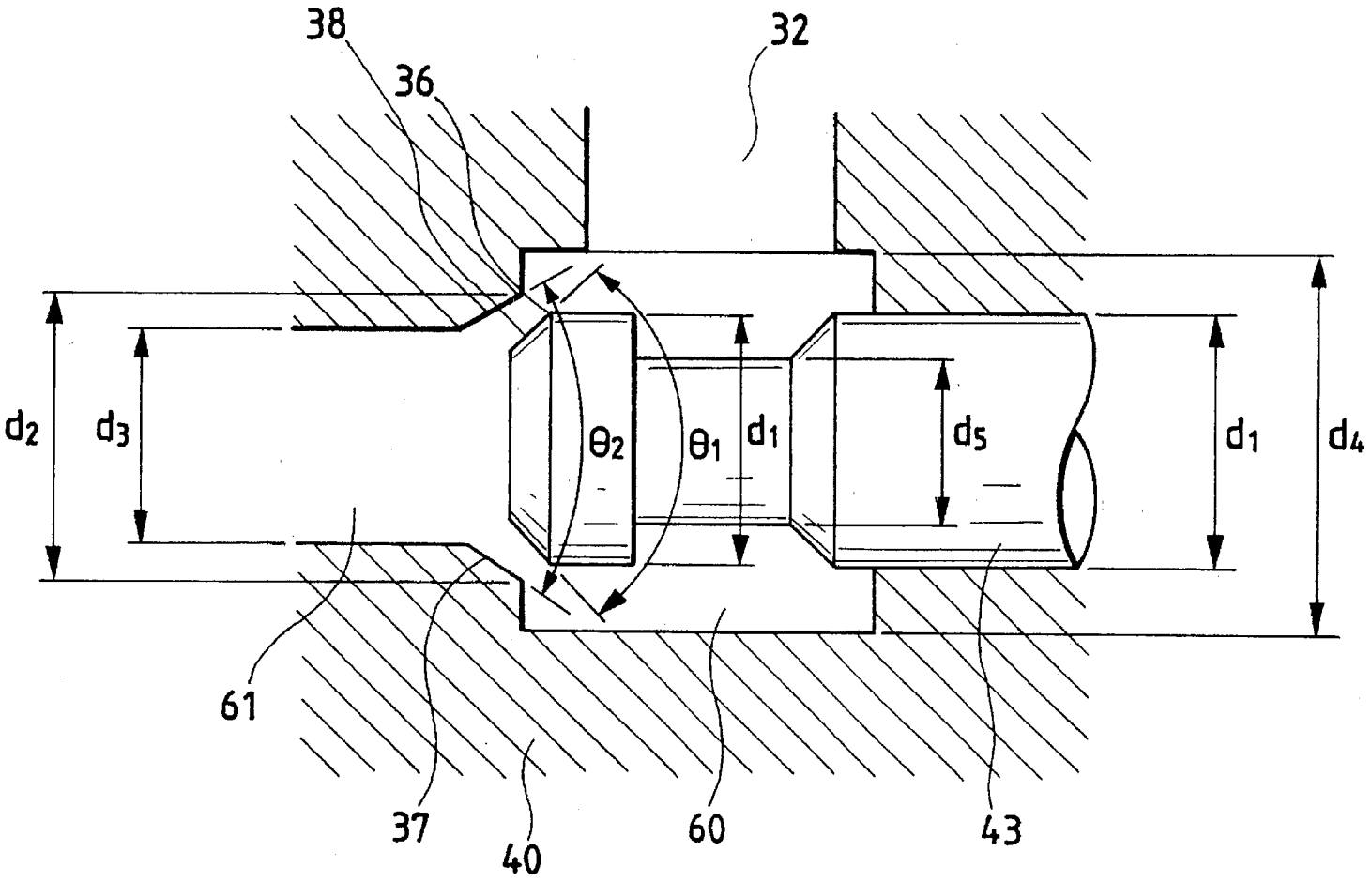
FIG. 5 is a sectional view shoving a main portion of the fuel-pressure control valve shown in FIG. 4.
Figure 6:
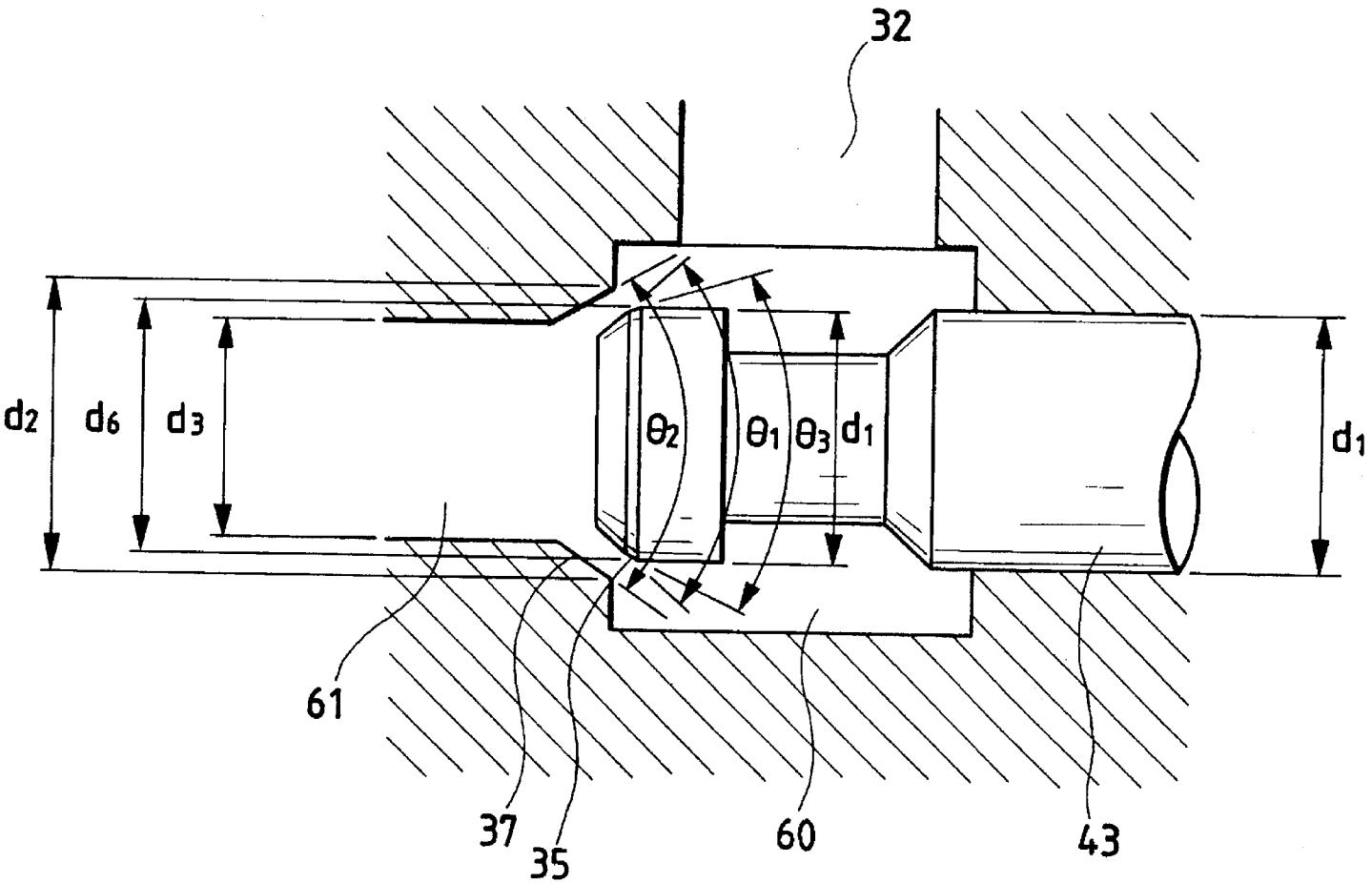
FIG. 6 is a sectional view showing a modification of the first preferred embodiment.

FIG. 6 shows a modification of the arrangement shown in FIG. 5. Specifically, in FIG. 6, the tip of the valve needle 43 has a stepped truncated-conical surface so as to further provide an inclination $\theta_3$. It is arranged that $\theta_3<\theta_2<\theta_1$, wherein $\theta_1$=93°, $\theta_2$=90°and $\theta_3$=80°. In this modification, a seal edge 35 having a valve diameter $d_6$=4.9 mm is provided. Since the diameter $d_6$ of the seal edge 35 is slightly smaller than or substantially equal to the diameter $d_1$ of the valve needle 43, a sufficiently large open area can be achieved with a small valve lift of the valve needle 43, similarly to the arrangement of FIG. 5.

Referring back to FIG. 5, if a diameter $d_4$ of the passage 60 is too large as compared with $d_1$ of the valve needle 43, the processing of the passage 60 becomes difficult. In view of this, a portion of the valve needle 43 is arranged to have a diameter $d_5$ which is smaller than $d_1$, so as to achieve a sufficiently large passage area of the passage 60. It is arranged that $d_4$=6.0 mm and $d_5$=3.5 mm.

Referring back to FIG. 4, a filter 34 having a filter aperture of 0.1 mm is disposed in the passage 32 upstream of the passage 60 in the valve body 40. The filter 34 is provided for preventing foreign matter from being trapped between the valve seat 37 and the truncated-conical surface 38 of the valve needle 43, thereby avoiding a normally-open state of the valve 27. For this purpose, the filter aperture of the filter 34 is set to 0.1 mm which is smaller than the valve lift $l_1$ of the valve needle 43, that is, the maximum valve lift of the valve needle 43.

Figure 17:
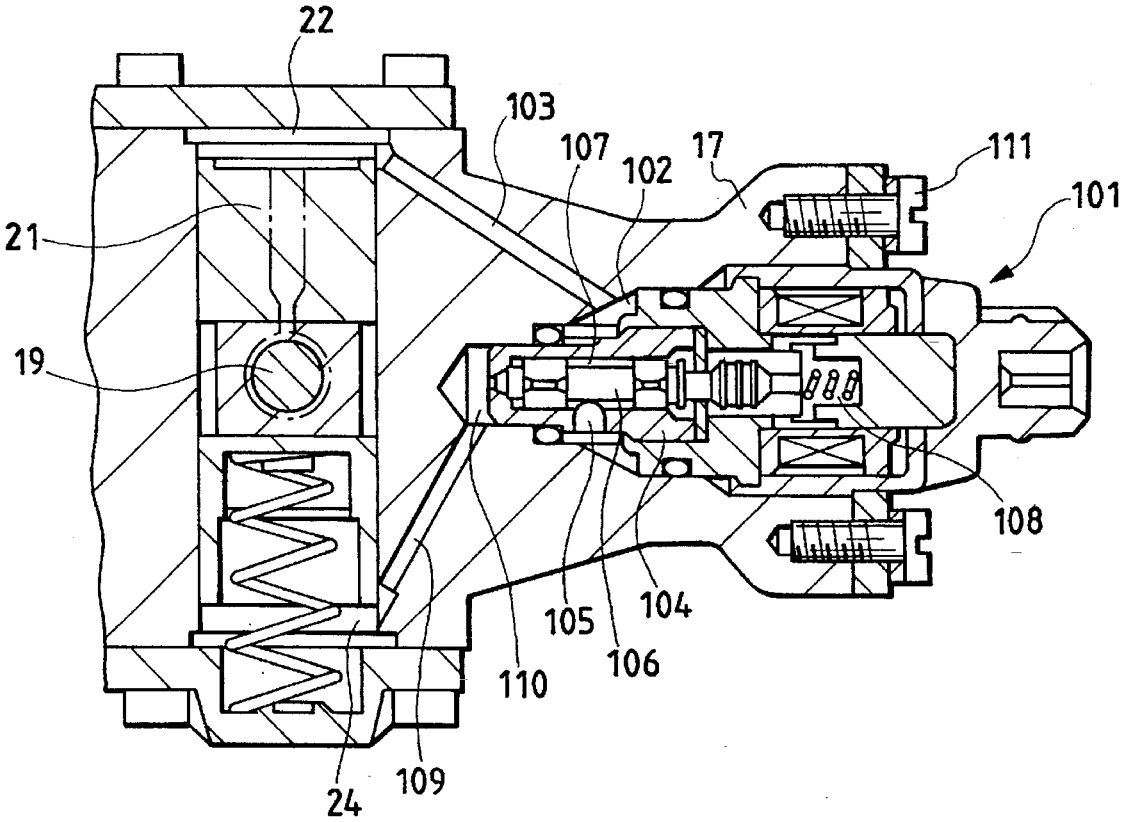
FIG. 17 PRIOR ART
FIG. 17 is a sectional view showing a fuel-pressure control valve in another conventional injection timing control device.

When the valve needle 43 together with the armature 52 moves, the volume of the spring chamber 62 changes correspondingly. In view of this, it is necessary to allow the spring chamber 62 to communicate with a certain portion for causing transfer of the fuel from the spring chamber 62. In case of the injection timing control device 28 shown in FIG. 1, once the fuel-pressure control valve 27 is closed, the passage 60 becomes higher in pressure than the passage 61 since the timer high-pressure chamber 22 is higher in pressure than the timer low-pressure chamber 24. Similarly, in case of the injection timing control device 28' shown in FIG. 2, the passage 60 becomes higher in pressure than the passage 61. Therefore, if the passage 60 or the passage 32 upstream of the valve needle 43 is arranged to communicate with the spring chamber 62 as in the foregoing prior art shown in FIG. 17, the spring chamber 62 becomes higher in pressure than the passage 61 so that the valve needle 43 is urged leftward in the figure (valve closing direction), which may cause failure in operation of the valve 27. Further, as described before, since the timer high-pressure chamber 22 increases in pressure in proportion to fuel injection pressure during the high-pressure fuel feeding by the plunger 6, the fuel injection timing can not be controlled accurately if the passage upstream of the valve needle 43 is in communication with the spring chamber 62.

In view of the foregoing, in this preferred embodiment, the spring chamber 62 and the passage 61 downstream of the valve needle 43 communicate with each other via the passage 33, a communication passage 45 formed in the valve body 40 and a passage 46 formed in the shim 59. With this arrangement, the spring chamber 62 and the passage 61 are equal in pressure to each other so as to be balanced.

In case of the injection timing control device 28' shown in FIG. 2, since the off pressure in the timer low-pressure chamber 24 changes in the range from the atmospheric pressure to 10 atm., the oil pressure in the passage 61 also changes in the same pressure range. However, since the spring chamber 62 and the passage 61 are held equal in pressure to each other in this preferred embodiment, failure in operation of the valve needle 43 due to the pressure variation can be effectively prevented.

In this preferred embodiment, the filter 34 is provided in the passage 32 within the valve body 40. However, the filter 34 may be provided at any appropriate position in a fuel line from the fuel chamber 15 to the passage 60 via the timer high-pressure chamber 22. In case of the injection timing control device 28' shown in FIG. 2, the filter 34 may be provided at any appropriate position in a fuel line from the fuel chamber 15 to the passage 60.

Now, an operation of the first preferred embodiment will be described with reference to FIGS. 1 and 4.

When the coil 54 is energized by the ECU 5, the valve needle 43 moves to a valve opening position against the biasing force of the spring 57 so that the fuel-pressure control valve 27 is opened. Accordingly, the oil (fuel) in the timer high-pressure chamber 22 flows into the timer low-pressure chamber 24 so that the pressure in the timer high-pressure chamber 22 is lowered. Thus, the timer piston 21 moves rightward in the figure due to the biasing force of the spring 25 so as to change the fuel injection timing in a retarding direction. On the other hand, when the ECU 5 deenergizes the coil 54, the valve needle 43 moves to a valve closing position due to the biasing force of the spring 57 so that the fuel-pressure control valve 27 is closed. Accordingly, communication between the timer high-pressure chamber 22 and the timer low-pressure chamber 24 is prohibited. Thus, the oil pressure in the timer high-pressure chamber 22 increases to the pressure in the fuel chamber 15 so that the timer piston moves leftward in the figure to change the fuel injection timing in an advancing direction.

As appreciated from the foregoing description, in the first preferred embodiment, since the valve lift $l_1$ can be set to a small value of 0.12 mm due to the arrangement of the seat section of the fuel-pressure control valve 27, that is, the shapes of the surface 38 of the valve needle 43 and the valve seat 37, the air gap $l_2$ before the coil 54 attracts the armature 52 can also be set small. Accordingly, the number of coil turns N can be reduced to enhance the valve opening response of the fuel-pressure control valve 27. Thus, the synchronous control of the valve 27 relative to the engine rotation can be achieved without need for the large quantity of current and therefore without increasing the cost of the drive circuit for operating the valve 27.

Figure 7:
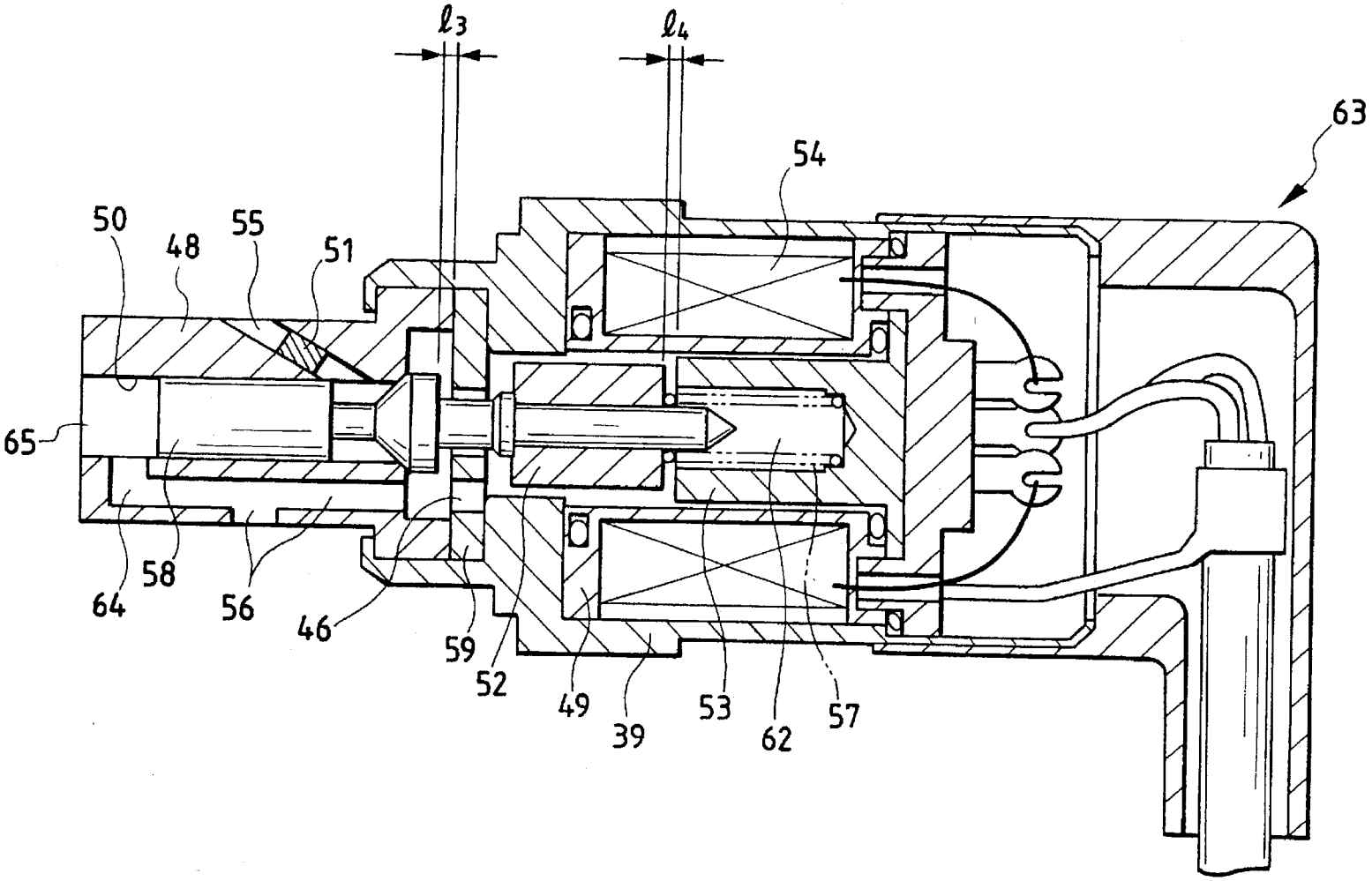
FIG. 7 is a sectional view showing an fuel-pressure control valve on an enlarged scale according to a second preferred embodiment of the present invention.
Figure 8:
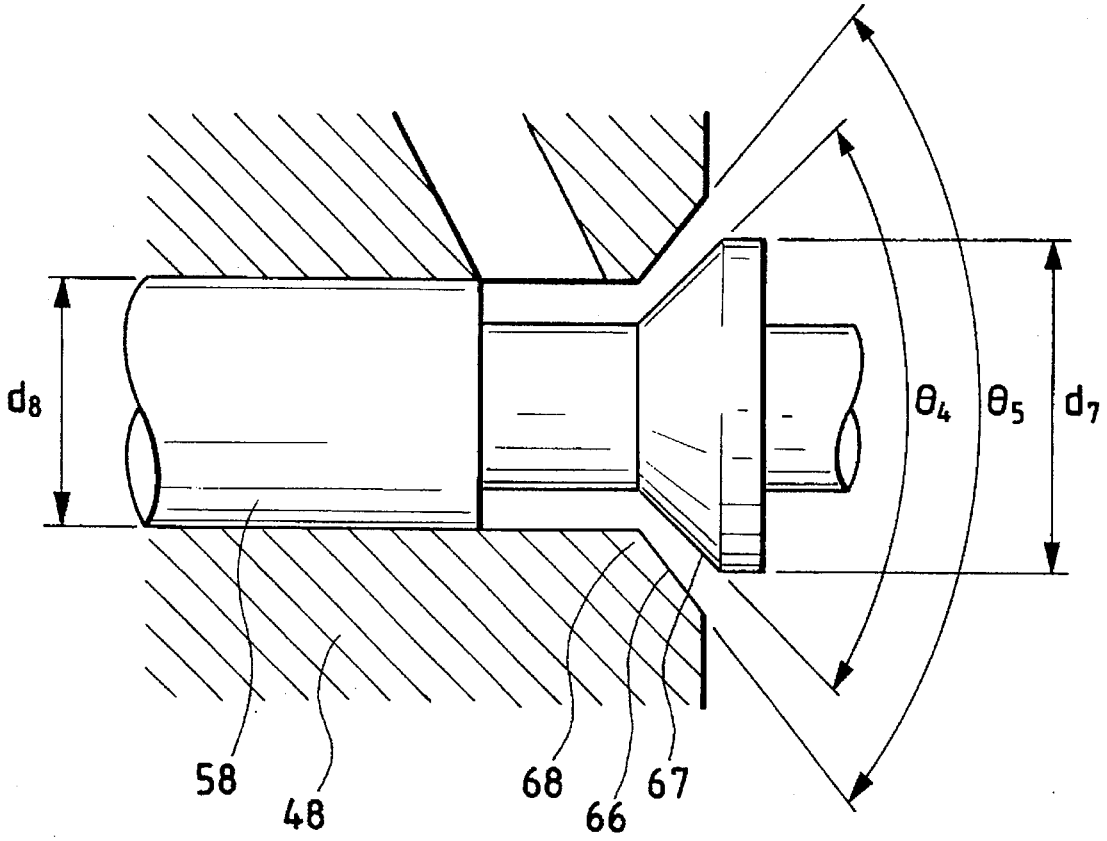
FIG. 8 is a sectional view showing a main portion of the fuel-pressure control valve shown in FIG. 7.

Now, a second preferred embodiment of the present invention will be described hereinbelow with reference to FIGS. 7 and 8.

Through the center of a valve body 48 is formed a valve cylinder 50 for slidably receiving therein a valve needle 58. The valve needle 58 defines in the valve cylinder 50 a valve body chamber 65 at its tip or left end in the figure. Passages 55 and 56 are further formed in the valve body 48 at opposite sides thereof and communicate with the valve cylinder 50, respectively. The passage 55 communicates with the timer high-pressure chamber 22 in case of the injection timing control device 28 shown in FIG. 1 or the fuel chamber 15 in case of the injection timing control device 28' shown in FIG. 2. On the other hand, the passage 56 communicates with the timer low-pressure chamber 24. In the passage 55 is disposed a filter 51 having a filter aperture of 0.1 mm which is smaller than a valve lift $l_3$=0.12 mm of the valve needle 58. The filter 51 may be arranged at any appropriate portion as described in the foregoing first preferred embodiment.

The valve needle 58 is received in the valve cylinder 50 so as to be slidable rightward and leftward in the figure. An armature 52 is fixed on the valve needle 58 on the right side thereof in the figure by press fitting. The nature 52 confronts a stator 53 with an interval (air gap) $l_4$ therebetween. When a coil 54 is deenergized by the ECU 5, the valve needle 58 is pressed toward a valve closing position due to a biasing force of a spring 57 disposed in a spring chamber 62 so that an off-pressure control valve 63 is closed. Accordingly, in the second preferred embodiment, the valve 63 is also arranged to be normally closed as in the foregoing first preferred embodiment. On the other hand, when the coil 54 is energized by the ECU 5, the armature 52 together with the valve needle 58 is attracted by the stator 53 against the biasing force of the spring 57 so that the valve needle 58 is lifted by $l_3$=0.12 mm to open the valve. At this time, $l_4$=0.05 mm.

The spring chamber 62 and the valve body chamber 65 communicate with each other via a passage 64 formed in the valve body 48, the passage 56 and a passage 46 formed through a shim 59. With this arrangement, the spring chamber 62 and the valve body chamber 65 are held equal or balanced in pressure to each other so as to avoid failure in operation of the valve needle 58 due to the fuel pressure variation.

Now, a seat section of the oil-pressure control valve 63 will be described with reference to FIG. 8. As appreciated, FIG. 7 shows the state where the valve is closed, while FIG. 8 shows the state where the valve is opened. In FIG. 8, it is arranged that an inclination $\theta_5$ of a truncated-conical surface of the valve seat 66 is set to 93°, while an inclination $\theta_4$ of a truncated-conical surface 67 formed at an intermediate portion of the valve needle 58 is set to 90°. It is further arranged that a diameter $d_8$ of the valve needle 58 is set to 5.0 mm and an outer or largest diameter $d_7$ of the truncated conical surface 67 is set to 5.5 mm.

With this arrangement, when the valve needle 58 is pressed toward the valve closing position due to the biasing force of the spring 57, a seal edge 68 of the truncated-conical surface of the valve seat 66 and the truncated-conical surface 67 of the valve needle 58 tightly abut each other to prohibit communication between the passages 55 and 56. It may be arranged that the spring seat 66 has a stepped truncated-conical surface so as to set the seal edge 68 to be slightly larger than $d_8$.

As appreciated, in this preferred embodiment, a sufficiently large open area can be achieved between the truncated-conical spring seat 66 and the truncated-conical surface 67 with a small valve lift of the valve needle 58, similarly to the foregoing first preferred embodiment.

In the second preferred embodiment, the processing of the spring seat 66 and the truncated-conical surface 67 of the valve needle 58 is facilitated as compared with the foregoing first preferred embodiment.

Further, in the second preferred embodiment, a valve opening direction of the valve needle 58 is essentially the same as a flow direction of the fuel passing through the off-pressure control valve 63 when the valve 63 is opened. On the other hand, in the foregoing first preferred embodiment, a valve opening direction of the valve needle 43 is essentially opposite to a flow direction of the fuel passing through the fuel-pressure control valve 27 when the valve 27 is opened. Specifically, as appreciated from FIG. 8, in the second preferred embodiment, the fuel flows between the spring seat 66 and the truncated-conical surface 67 essentially in the valve opening direction of the valve needle 58. On the other hand, as appreciated from FIG. 5, in the first preferred embodiment, the fuel flows between the spring seat 37 and the truncated-conical surface 38 in a direction essentially opposite to the valve opening direction of the valve needle 43. Further, while the truncated-conical surface 38 is provided at the tip of the valve needle 43 in the first preferred embodiment, the truncated-conical surface 67 is provided at a position which is away from the tip of the valve needle 58 in the valve opening direction.

Now, a third preferred embodiment of the present invention will be described hereinbelow with reference to FIGS. 9 to 12.

Figure 9:
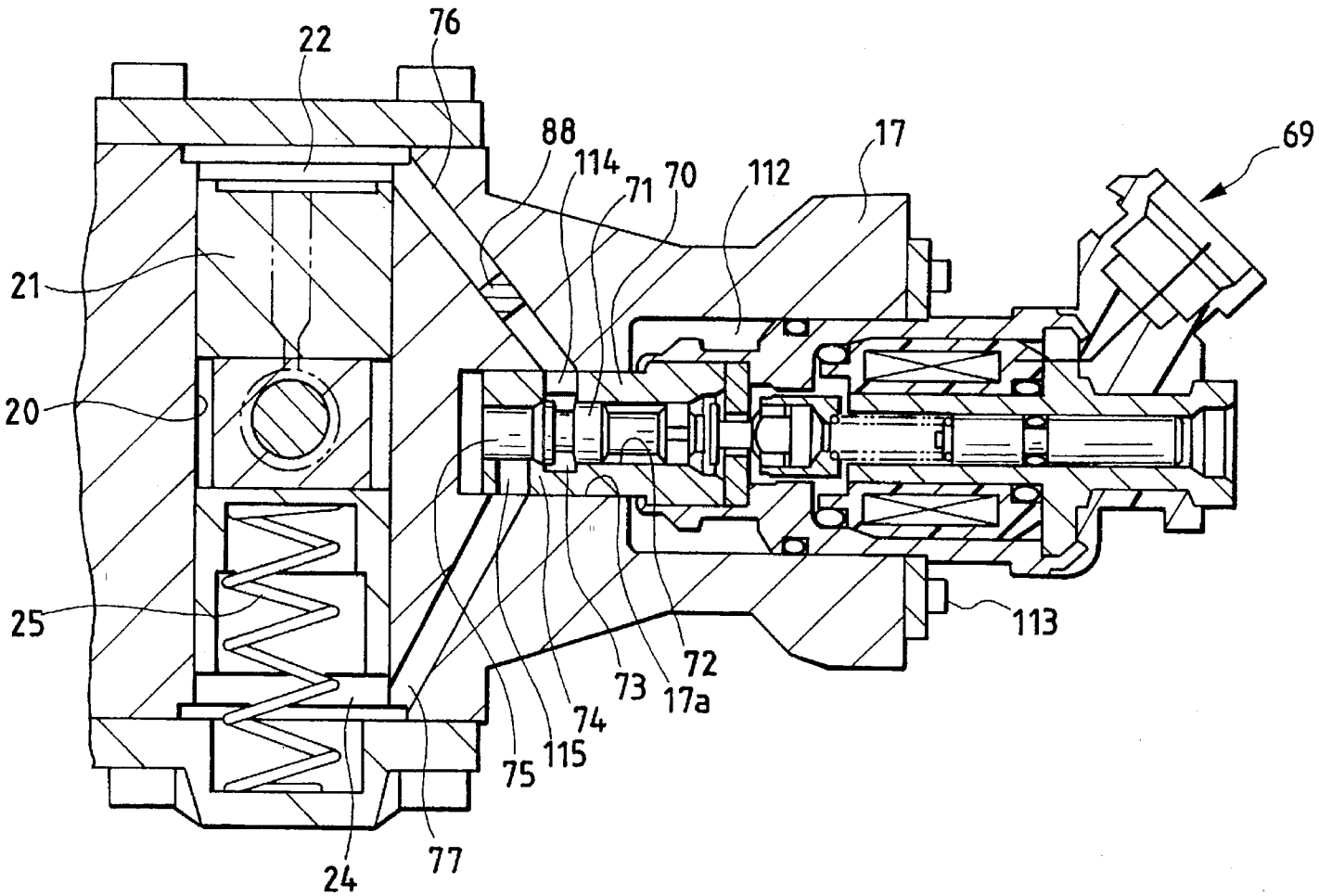
FIG. 9 is a sectional view showing an injection timing control device for a fuel injection pump according to a third preferred embodiment of the present invention, wherein an fuel-pressure control valve is illustrated as being associated with a timer cylinder.

In FIG. 9, a valve body 70 is formed through its center with a valve cylinder 72 for slidably receiving a valve needle 71 therein. The valve cylinder 72 includes an annular passage 73 and a passage 75 at a downstream side of the annular passage 73. The annular passage 73 and the passage 75 cooperatively form a valve seat 74 for the valve needle 71. The valve body 70 is fitted in a housing 17. The annular passage 73 communicates with a timer high-pressure chamber 22 via a passage 114 formed in the valve body 70 and a passage 76 formed in the housing 17. On the other hand, the passage 75 communicates with a timer low-pressure chamber 24 via a passage 115 formed in the valve body 70 and a passage 77 formed in the housing 17.

In case of the injection timing control device 28' of the timer low-pressure chamber control mode as shown in FIG. 2, the annular passage 73 communicates with the fuel chamber 15 via the passage 114, instead of the timer high-pressure chamber 22.

Figure 10:
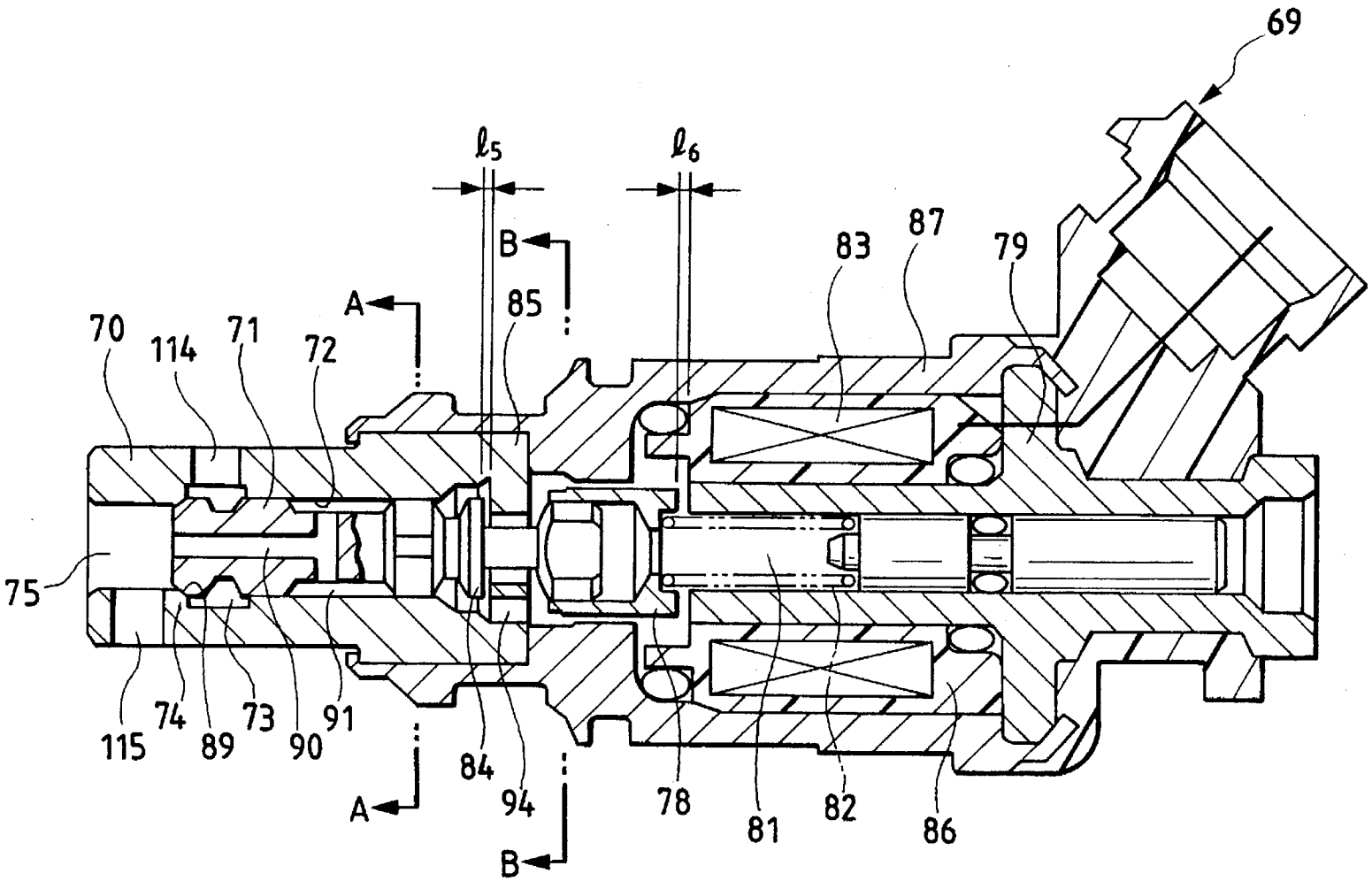
FIG. 10 is a sectional view showing the fuel-pressure control valve shown in FIG. 9 on an enlarged scale.

FIG. 10 shows a fuel-pressure control valve 69 shown in FIG. 9 on an enlarged scale. In the valve cylinder 72, the valve needle 71 is disposed so as to be slidable rightward and leftward in the figure. An armature 78 is fixed on the valve needle 71 on the right side thereof in the figure by laser welding. The armature 78 confronts a stator 79 with an interval (air gap) 16 therebetween. In the stator 79 is formed a spring chamber 81 in which a spring 82 is disposed for urging the armature 78 leftward in the figure.

Accordingly, when a coil 83 is deenergized, the tip of the valve needle 71 abuts the valve seat 74 so that the fuel-pressure control valve 69 is closed to prohibit communication between the timer high-pressure chamber 22 and the timer low-pressure chamber 24. On the other hand, when the coil 83 is energized, the armature 78 is attracted by the stator 79 to move rightward in the figure against the biasing force of the spring 82 so that the tip of the valve needle 71 integrated with the armature 78 is separated from the valve seat 74. Thus, the oil-pressure control valve 69 is opened to establish communication between the timer high-pressure chamber 22 and the timer low-pressure chamber 24. A valve lift $l_5$ of the valve needle 71 at this time is $l_5$=0.12 mm. As appreciated, the lift motion of the valve needle 71 is finished at a position where a right shoulder 84 of the valve needle 71 abuts a shim 85. The air gap 16 is $l_6$=0.17 mm when the valve is closed, while $l_6$=0.05 mm when the valve is opened.

Since it is preferable to most advance the fuel injection timing rather than most retard the fuel injection timing, assuming failure of the coil 83, the fuel-pressure control valve 69 is arranged to be normally closed as described above.

The coil 83 is wound around a coil bobbin 86 and received in a casing 87. A left end, in the figure, of the casing 87 is caulked so as to fix the valve body 70 thereto, and a right end thereof is also caulked to fix the stator 79 thereto.

A structure of a seat section of the fuel-pressure control valve 69, that is, a structure around a tip portion of the valve needle 71 including the valve seat 74 of the valve body 70, is substantially the same as that in the foregoing first preferred embodiment.

As shown in FIG. 9, in the passage 76 within the housing 17 is disposed a filter 88 having a filter aperture of 0.1 mm. The filter 88 is provided for preventing foreign matter from being trapped between the valve seat 74 and a truncated-conical surface 89 of the valve needle 71, thereby avoiding a normally-open state of the valve 69. For this purpose, the filter aperture of the filter 88 is set to 0.1 mm which is smaller than the valve lift $l_5$ of the valve needle 71, that is, the maximum valve lift of the valve needle 71.

In this preferred embodiment, the filter 88 is provided in the passage 76 within the housing 17. However, the filter 88 may be provided at any appropriate position in a fuel line from the fuel chamber 15 to the passage 73 via the timer high-pressure chamber 22. In case of the injection timing control device 28' shown in FIG. 2, the filter 88 may be provided at any appropriate position in a fuel line from the fuel chamber 15 to the passage 73.

Figure 12:
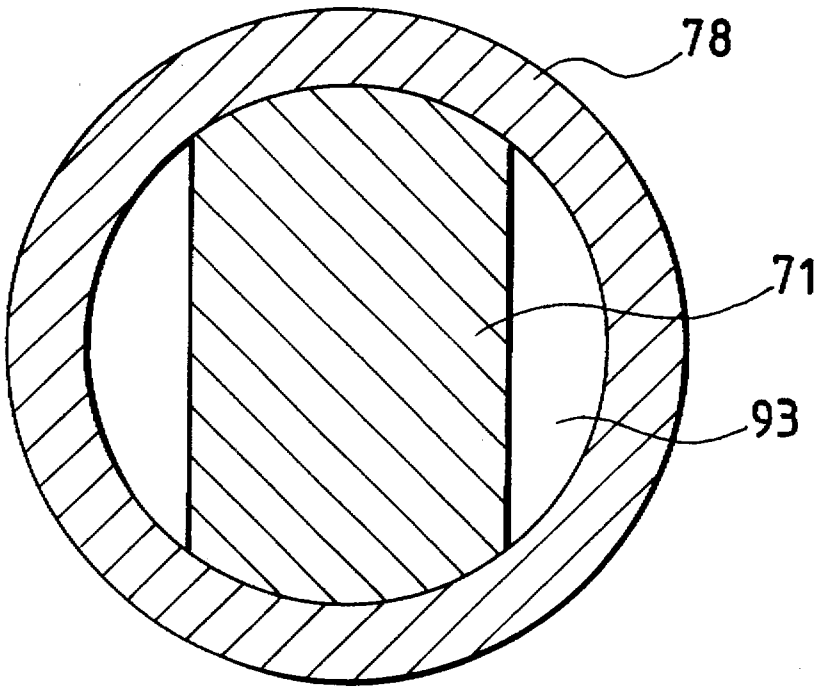
FIG. 12 is a sectional view taken along line B—B in FIG. 10.
Figure 11:
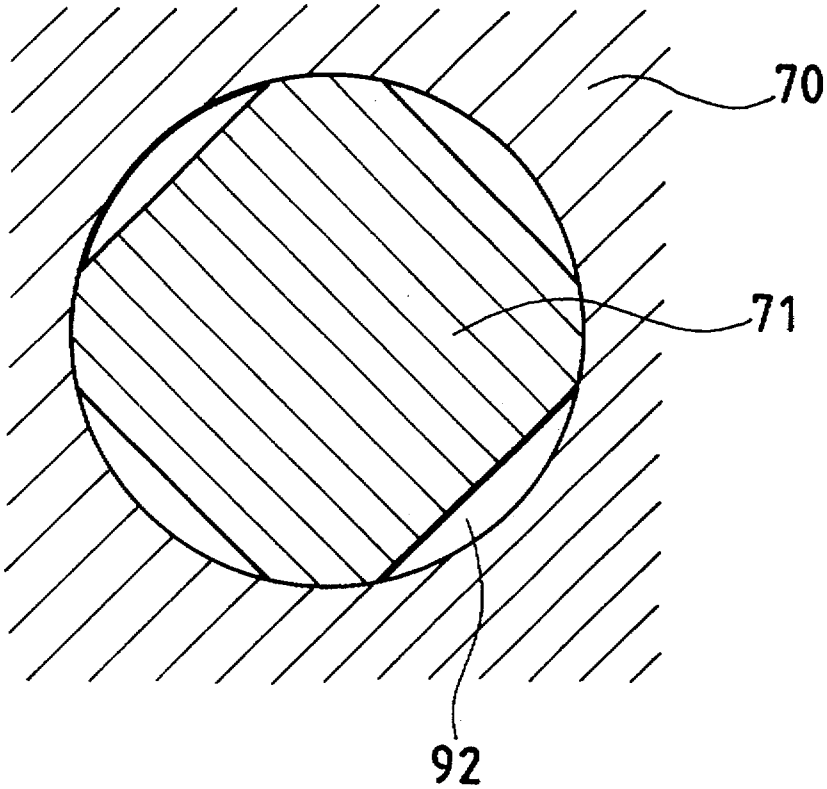
FIG. 11 is a sectional view taken along line A—A in FIG. 10.

In this preferred embodiment, the passage 75 located downstream of the valve needle 71 and of the valve seat 74 and the spring chamber 81 are in communication with each other for balancing fuel pressures applied at opposite axial ends of the valve needle 71, as in the foregoing first preferred embodiment. Specifically, the passage 75 communicates with a needle chamber 91 provided surrounding the valve needle 71 via a communication passage 90 formed in the valve needle 71. When the valve needle 71 is at a valve closing position, that is, the valve 69 is closed, communication between the needle chamber 91 and the passage 73 is prohibited. Further, as shown in FIGS. 11 and 12, passages 92 and 93 are further provided for communication between the needle chamber 91 and the spring chamber 81 via a passage 94 formed through the shim 85.

By providing the communication passage 90 in the valve needle 71, the valve needle 71 can be lightened as compared with the foregoing first preferred embodiment. This improves the response characteristic of the valve needle 71. Further, since the passage 75 and the spring chamber 81 can be connected by the shortest distance, the pressure variation in the passage 75 can be quickly transmitted to the spring chamber 81. On the other hand, as compared with the conventional structure shown in FIG. 17, the valve body 70 is received in a TCV (timing control valve) cylinder 17*a* formed in the housing 17 so that the passage 76 communicates with the passage 114 directly, that is, not through a housing chamber 112. Thus, the fuel-pressure control valve 69 is prevented from repeatedly receiving loads rightward in the figure as opposed to the structure of FIG. 17 so that bolts 113 are prevented from being subjected to fatigue failure. This advantage is also achieved in the foregoing first and second preferred embodiments as appreciated from FIGS. 1 to 3.

With the foregoing arrangement, parts of a fuel injection valve (solenoid valve) for injecting fuel into an intake passage in the gasoline engine can be used for the armature 78, the spring 82, the stator 79, the coil 83, the coil bobbin 86 and others of the fuel-pressure control valve 69. This contributes to reduction in cost for manufacturing the valve 69.

In this preferred embodiment, as described above, the seat section of the fuel-pressure control valve 69 is substantially the same as that in the foregoing first preferred embodiment. On the other hand, it may be arranged that the seat section of the valve 69 is substantially the same as that in the foregoing second preferred embodiment as shown in FIGS. 7 and 8.

Figure 13:
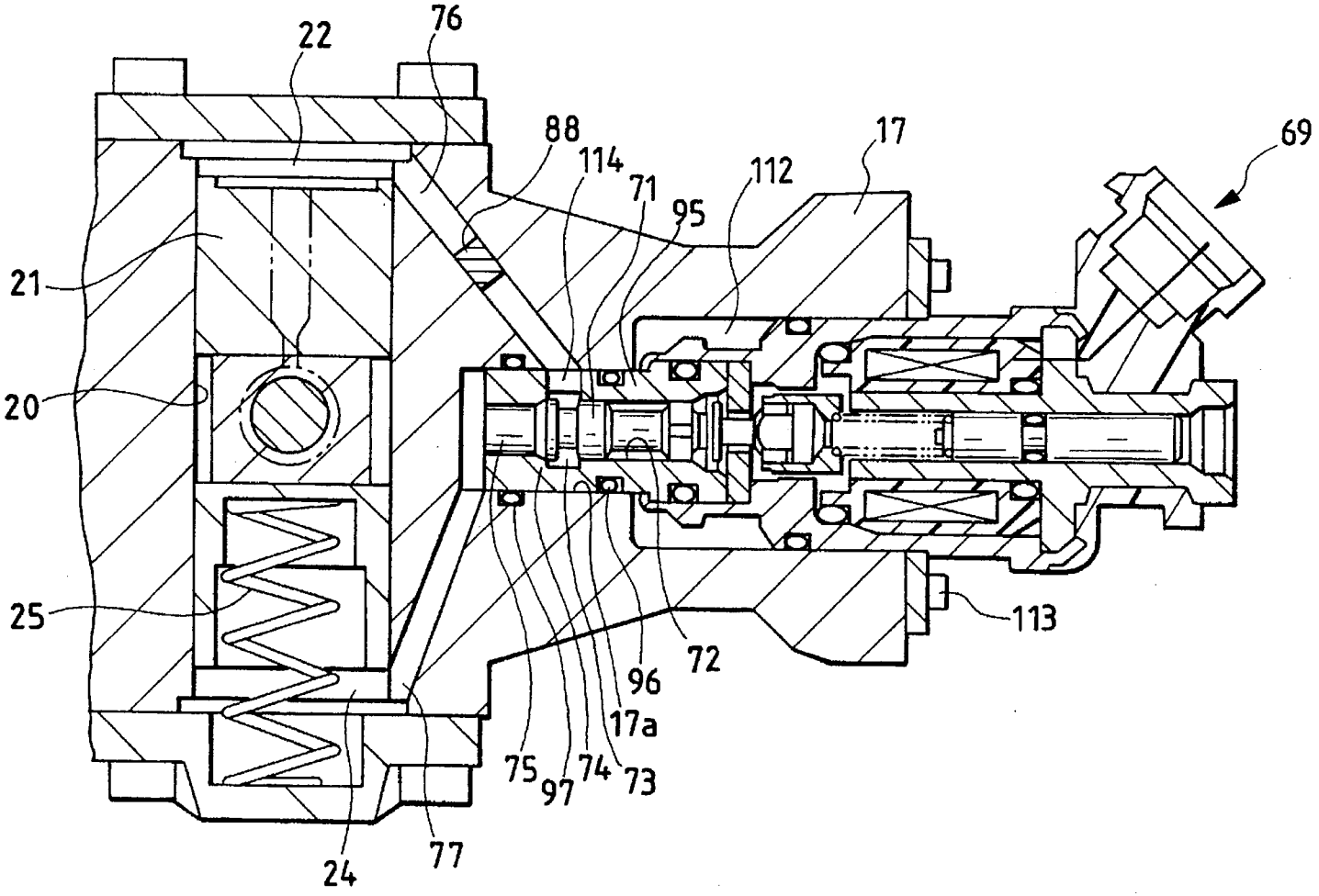
FIG. 13 is a sectional view showing a modification of the third preferred embodiment.

FIG. 13 shows a modification of the third preferred embodiment. As shown in FIG. 13, by disposing O-rings 96 and 97 between the housing 17 and a valve body 95, failure in advancing the fuel injection timing due to leakage of the fuel from between the housing 17 and the valve body 95 can be prevented. This improved arrangement may also be applied to the structures of the foregoing preferred embodiments.

While the present invention has been described in terms of the preferred embodiments, the invention is not to be limited thereto, but can be embodied in various ways without departing from the principle of the invention as defined in the appended claims.

For example, each of the foregoing fuel-pressure control valves can be applied not only to the distributor type fuel injection pump of a face-cam feeding type as shown in FIG. 1 or 2, but also to a distributor type fuel injection pump of an inner-cam feeding type, and further to a distributor type fuel injection pump using a servo timer.

What is claimed is:

1. An injection timing control device for a fuel injection pump, comprising:

a timer cylinder;

a timer high-pressure chamber and a timer low-pressure chamber provided at opposite ends of said timer cylinder;

a timer piston slidably received in said timer cylinder and movable depending on a pressure differential between said timer high-pressure chamber and said timer low-pressure chamber to adjust an injection timing of fuel; and a fuel-pressure control valve for changing a fuel pressure in at least one of said timer high-pressure chamber and said timer low-pressure chamber;

said fuel-pressure control valve comprising:

a valve body defining a first passage configured to contain high-pressure fuel and defining a second passage for draining said high-pressure fuel;

a valve cylinder formed in said valve body and having a valve seat, said valve seat having a first truncated-conical surface;

a valve needle slidably received in said valve cylinder, said valve needle having a second truncated-conical surface for engaging with said first truncated-conical surface to close a path between said first passage and said second passage and disengaging from said first truncated-conical surface to open said path;

an armature fixed to said valve needle;

a spring biasing said valve needle in a direction to close said path;

an electromagnetic coil which, when energized, generates an attraction force to attract said armature against a biasing force of said spring so that said valve needle opens said path; and means for introducing a fuel pressure applied to one axial end of said valve needle to the opposite axial end of said valve needle thereby equalizing fuel pressures at each axial end of said valve needle, wherein said first and second truncated-conical surfaces, when engaged, form a circular seal line between said first and second truncated-conical surfaces, said circular seal line having a diameter which is substantially the same as a diameter of said valve needle.

2. The injection timing control device according to claim 1, wherein said pressure introducing means comprises a communication passage formed in said valve needle.

3. The injection timing control device according to claim 1, wherein a filter is provided at an upstream side of said valve seat.

4. The injection timing control device according to claim 3, wherein said filter has a filter aperture which is smaller than a maximum valve lift of said valve needle.

5. The injection timing control device according to claim 1, wherein a valve opening direction of said valve needle is essentially opposite to a flow direction of the fuel passing through said oil-pressure control valve when opened.

6. The injection timing control device according to claim 5, wherein said valve needle has first and second axial sides, said first axial side located in said valve opening direction with respect to said second axial side, and wherein said valve needle has said truncated-conical surface at said second side.

7. The injection timing control device according to claim 1, wherein a valve opening direction of said valve needle is essentially the same as a flow direction of the fuel passing through said oil-pressure control valve when opened.

8. The injection timing control device according to claim 7, wherein said valve needle has first and second axial sides, said first axial side located in said valve opening direction with respect to said second axial side, and wherein said valve needle has said truncated-conical surface at said first side.

9. The injection timing control device according to claim 1, wherein an inclination of said first truncated-conical surface is smaller than an inclination of said second truncated-conical surface.

10. The injection timing control device according to claim 1, wherein an inclination of said first truncated-conical surface is greater than an inclination of said second truncated-conical surface.

11. The injection timing control device according to claim 1, wherein said valve body is received in a housing and an O-ring is provided between said housing and said valve body.

* * * * *